US012630958B2

(12) United States Patent
Reeves et al.

(10) Patent No.: US 12,630,958 B2
(45) Date of Patent: May 19, 2026

(54) LIGHT-EMITTING DEVICES FOR INDICATING A WASH OPERATION OF AN APPLIANCE

(71) Applicant: Haier US Appliance Solutions, Inc., Wilmington, DE (US)

(72) Inventors: Joshua Reeves, Louisville, KY (US); Stannard Nathan Phelps, Cadiz, KY (US); Kelsey King, Fisherville, KY (US); Mary Joy Cardilino Gentry, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 277 days.

(21) Appl. No.: 18/360,340

(22) Filed: Jul. 27, 2023

(65) Prior Publication Data

US 2025/0034782 A1 Jan. 30, 2025

(51) Int. Cl.

| | |
|---|---|
| ***D06F 34/32*** | (2020.01) |
| ***D06F 33/34*** | (2020.01) |
| ***D06F 33/36*** | (2020.01) |
| ***D06F 33/42*** | (2020.01) |
| ***D06F 34/30*** | (2020.01) |
| *D06F 105/60* | (2020.01) |

(52) U.S. Cl.

CPC ..... *D06F 34/32* (2020.02); *D06F 33/34* (2020.02); *D06F 33/36* (2020.02); *D06F 33/42* (2020.02); *D06F 34/30* (2020.02); *D06F 2105/60* (2020.02)

(58) Field of Classification Search

CPC ..... D06F 34/28; D06F 34/30; D06F 34/32; D06F 2105/56; D06F 2105/58; D06F 2105/60

See application file for complete search history.

(56) References Cited

U.S. PATENT DOCUMENTS

| | | | | |
|---|---|---|---|---|
| 9,957,658 | B2 | 5/2018 | Zhu et al. | |
| 9,976,244 | B2 | 5/2018 | Yang et al. | |
| 11,384,465 | B2 | 7/2022 | Carpenter et al. | |
| 2011/0047716 | A1* | 3/2011 | Cho | D06F 34/08 8/137 |
| 2013/0271259 | A1* | 10/2013 | Brasseur | D06F 34/28 340/4.31 |

(Continued)

FOREIGN PATENT DOCUMENTS

| | | | |
|---|---|---|---|
| CN | 108796984 | B | 11/2020 |
| DE | 102012220255 | A1 | 5/2014 |

(Continued)

OTHER PUBLICATIONS

Machine Translation of Geyer, WO-03023118-A1, Mar. 2003. (Year: 2003).*

*Primary Examiner* — David G Cormier

(74) *Attorney, Agent, or Firm* — Dority & Manning, P.A.

(57) ABSTRACT

A method for indicating a wash operation of a wash cycle of an appliance is provided. The wash operation is indicated on a user interface of the appliance. The method includes initiating the wash cycle of the appliance via the user interface. During the wash cycle, the method includes operating an arrangement of light-emitting devices on the user interface of the appliance to animate the wash operation. One or more of the light-emitting devices are turned on and off in a manner that corresponds to the wash operation during the wash cycle.

9 Claims, 11 Drawing Sheets

(56) References Cited

U.S. PATENT DOCUMENTS

| | | | | |
|---|---|---|---|---|
| 2015/0345068 | A1* | 12/2015 | Coffman | G06F 3/0488<br>715/771 |
| 2018/0127911 | A1* | 5/2018 | Chen | D06F 39/14 |
| 2018/0291550 | A1* | 10/2018 | Niu | D06F 29/00 |

FOREIGN PATENT DOCUMENTS

| | | | | |
|---|---|---|---|---|
| EP | 1427880 | B1 | 10/2006 | |
| JP | 2004283269 | A | 10/2004 | |
| WO | WO-03023118 | A1 * | 3/2003 | D06F 34/32 |

* cited by examiner

LIGHT-EMITTING DEVICES FOR INDICATING A WASH OPERATION OF AN APPLIANCE

FIELD OF THE INVENTION

The present disclosure relates generally to appliances, and more specifically to sensory indicators for an appliance.

BACKGROUND OF THE INVENTION

Typically, appliances, such as washing machines and dishwashers, are used to wash articles, such as clothes, accessories, dishes, pots, pans and other items. Such appliances typically include a wash tub for receiving articles and a user interface or control panel for receiving user inputs. Additionally, washing machines and dishwashers can perform a variety of different wash operations. For example, the user interface can include a display for providing information related to the various wash operations. As such, the user interface may include an input controller for a user to select a wash cycle for the appliance to perform. Each wash cycle includes various wash operations, such as fill sequences, spin sequences, drain sequences, etc. In addition, the types of wash operations, the number of wash operations, and/or the order of wash operations performed during a wash cycle typically vary depending on the wash cycle that the user selects.

Furthermore, the display and/or the input controller may indicate the wash cycle selected by the user or the completion of the various wash operations, notifying the user that a wash cycle (or a wash operation) is complete. However, such features may not include all relevant information important to users, such as how much time remains in a particular wash operation of a wash cycle. Additionally, the user interface may provide the information in a manner that is inconvenient or unfeasible for the user due to inability to read text from a distance or comprehend the language in which information is provided.

In view of the aforementioned, an appliance having improved features to indicate the progress of various wash operations performed during a wash cycle would be welcomed in the art.

BRIEF DESCRIPTION OF THE INVENTION

Aspects and advantages of the invention in accordance with the present disclosure will be set forth in part in the following description, or may be obvious from the description, or may be learned through practice of the technology.

In an aspect, the present disclosure is directed to a method of indicating a wash operation of a wash cycle of a washing machine appliance. The wash operation is indicated on a user interface of the washing machine appliance. The method includes initiating the wash cycle of the washing machine appliance via the user interface. During the wash cycle, the method includes operating an arrangement of light-emitting devices on the user interface of the washing machine appliance to animate the wash operation of the wash cycle. Further, operating the arrangement of light-emitting devices includes turning one or more of the light-emitting devices on and off in a manner that corresponds to the wash operation during the wash cycle.

In another aspect, the present disclosure is directed to an appliance. The appliance includes a cabinet defining an opening, a tub arranged within the cabinet, and a user interface. The tub is configured to contain fluid and articles during the operation of the appliance. The user interface is used for indicating a wash operation of a wash cycle. The user interface includes an input panel, a display screen, and an arrangement of light-emitting devices. The input panel has a controller operatively coupled with the user interface for selecting the wash cycle. The arrangement of light-emitting devices are for indicating at least one wash operation of the wash cycle. Further, the controller is configured to operate the arrangement of light-emitting devices to animate the at least one wash operation of the wash cycle by turning one or more of the light-emitting devices on and off in a manner that corresponds to the wash operation during the wash cycle.

These and other features, aspects and advantages of the present invention will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present invention, including the best mode of making and using the present systems and methods, directed to one of ordinary skill in the art, is set forth in the specification, which makes reference to the appended figures, in which.

DETAILED DESCRIPTION

Figure 1:
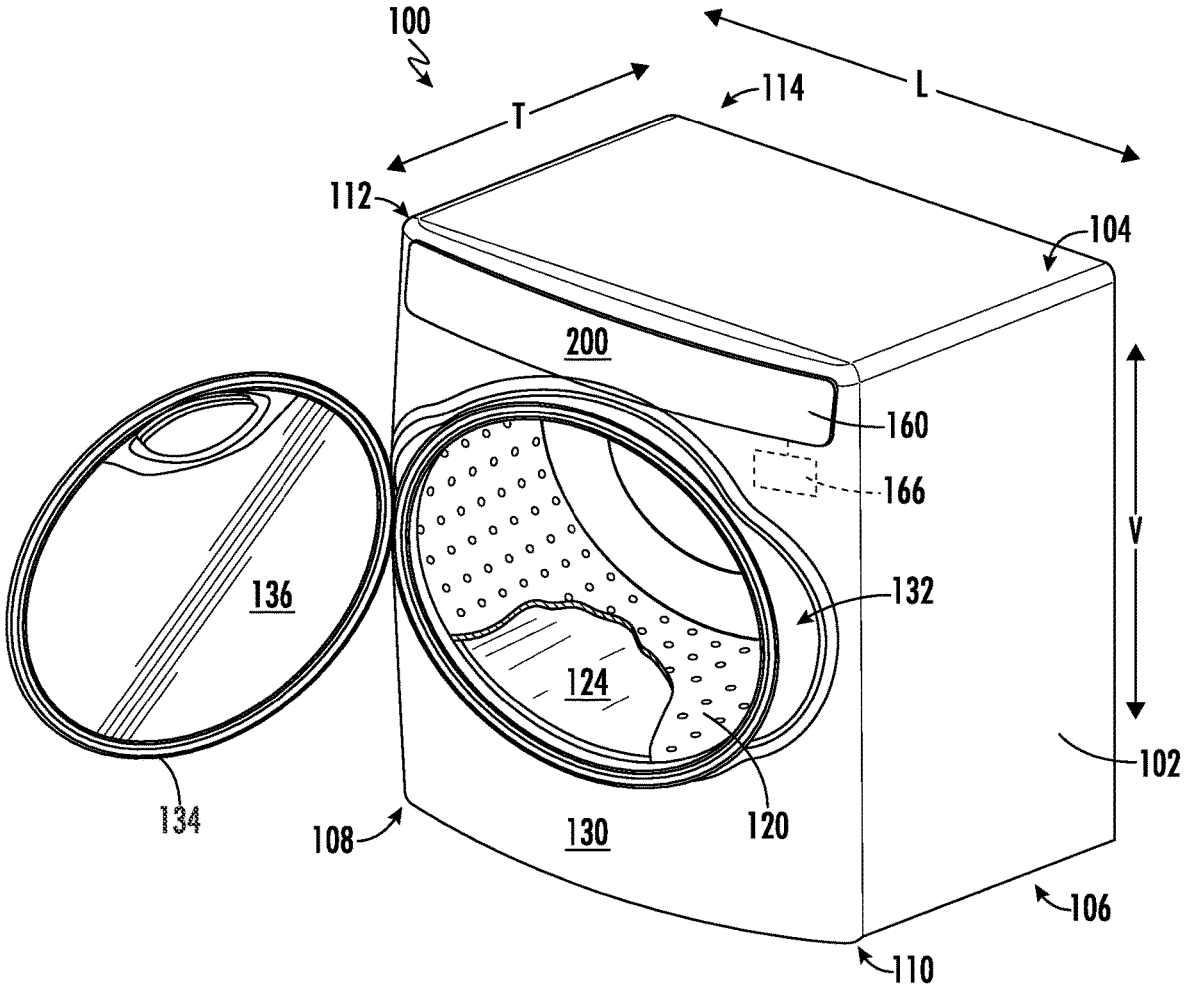
FIG. 1 provides a perspective view of a washing appliance as may incorporate a user interface in accordance with embodiments of the present disclosure.

Reference now will be made in detail to embodiments of the present invention, one or more examples of which are illustrated in the drawings. The word "exemplary" is used herein to mean "serving as an example, instance, or illustration." Any implementation described herein as "exemplary" is not necessarily to be construed as preferred or advantageous over other implementations. Moreover, each example is provided by way of explanation, rather than limitation of, the technology. In fact, it will be apparent to those skilled in the art that modifications and variations can be made in the present technology without departing from the scope or spirit of the claimed technology. For instance, features illustrated or described as part of one embodiment can be used with another embodiment to yield a still further embodiment. Thus, it is intended that the present disclosure covers such modifications and variations as come within the scope of the appended claims and their equivalents. The detailed description uses numerical and letter designations to refer to features in the drawings. Like or similar designations in the drawings and description have been used to refer to like or similar parts of the invention.

As used herein, the terms "first", "second", and "third" may be used interchangeably to distinguish one component from another and are not intended to signify location or importance of the individual components. The singular forms "a," "an," and "the" include plural references unless the context clearly dictates otherwise. The terms "coupled," "fixed," "attached to," and the like refer to both direct coupling, fixing, or attaching, as well as indirect coupling, fixing, or attaching through one or more intermediate components or features, unless otherwise specified herein. As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus.

Further, unless expressly stated to the contrary, "or" refers to an inclusive-or and not to an exclusive-or. For example, a condition A or B is satisfied by any one of the following: A is true (or present) and B is false (or not present). A is false (or not present) and B is true (or present), and both A and B are true (or present). The use of terms "top" and "bottom" herein are used for reference only as example embodiments disclosed herein are not limited to the vertical orientation shown nor to any particular configuration shown; other constructions and orientations may also be used.

Benefits, other advantages, and solutions to problems are described below with regard to specific embodiments. However, the benefits, advantages, solutions to problems, and any feature(s) that may cause any benefit, advantage, or solution to occur or become more pronounced are not to be construed as a critical, required, or essential feature of any or all the claims.

Referring now to the drawings, FIG. 1 illustrates a perspective view of an appliance 100, specifically a washing machine appliance 100, according to an exemplary embodiment of the present subject matter. It should be understood that the present disclosure is not limited to the washing machine appliance 100, and that any suitable appliance having a user input assembly is within the scope and spirit of the present disclosure. As illustrated, the washing machine appliance 100 generally defines a vertical direction V, a lateral direction L, and a transverse direction T, each of which is mutually perpendicular, such that an orthogonal coordinate system is generally defined. Further, as shown, the washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

Referring still to FIG. 1, the cabinet 102 also includes a front panel 130 defining an opening 132 that permits user access to a wash basket 120 within a wash tub 124. The wash tub 124 is mounted within the cabinet 102 and configured to contain articles and fluid during operation of the washing machine appliance 100. More specifically, as shown, the washing machine appliance 100 includes a door 134 that is positioned in front of the opening 132 and is rotatably mounted to the front panel 130. In particular, the door 134 is rotatable to permit selective access to the opening 132 by rotating between an open position (not shown) and a closed position to facilitate access to the wash tub 124.

Further, as shown, the door 134 may include a window 136 to permit viewing of the wash basket 120 when the door 134 is in the closed position, e.g., during operation of washing machine appliance 100. In addition, in an embodiment, the door 134 may also include a handle (not shown) that, e.g., a user may pull when opening and closing the door 134. Further, although the door 134 is illustrated as mounted to the front panel 130, it should be appreciated that the door 134 may be mounted to another side of the cabinet 102 or any other suitable support according to alternative embodiments.

Figure 2:
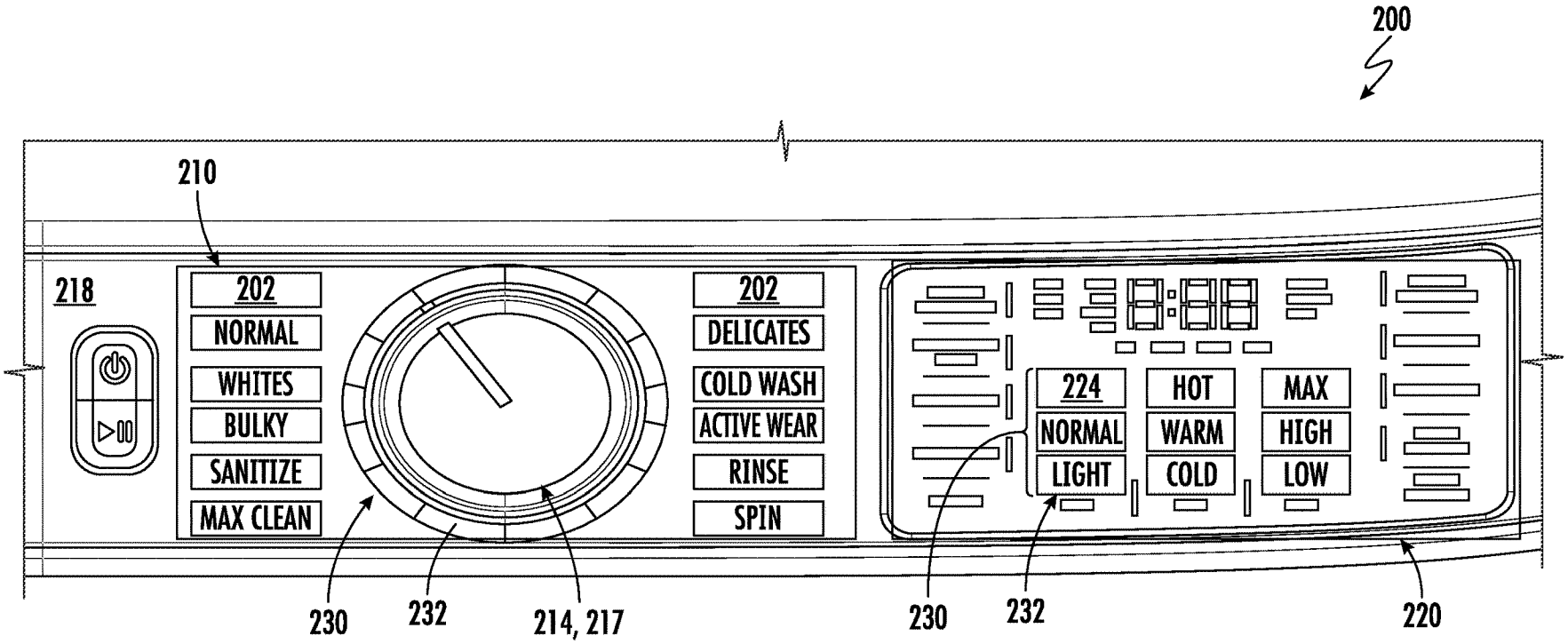
FIG. 2 provides a front view of a user interface of a washing appliance in accordance with embodiments of the present disclosure.

Referring to FIGS. 1 and 2, the washing machine appliance 100 may include a control panel 160 positioned on the front panel 130. Further, as shown, the control panel 160 includes a user interface 200 (FIG. 2) for operator selection of wash cycles and features. In an embodiment, for example, the control panel 160 may be used as part of a capacitive touch sensing system to allow for the selective activation, adjustment, or control of the washing machine appliance 100. In such embodiments, the control panel 160 may be the dielectric panel of the capacitive touch system whereby the capacitive touch system registers on the user interface 200. Additionally, the control panel 160 may also provide for the selective activation, adjustment, or control of any timer features or other user-adjustable inputs. One or more of a variety of electrical, mechanical, or electromechanical input devices including rotary dials, push buttons, toggle/rocker switches, and/or touch pads can also be used singularly or in combination with touch input components. The control panel 160 may also include a display component or display screen, such as a digital or analog display device designed to provide operational feedback to a user.

Furthermore, as shown in FIG. 1, operation of the washing machine appliance 100 can be regulated by a controller 166 that is operatively coupled, i.e., in communication with, the user interface 200. By way of example, the controller 166 may include a memory and one or more processing devices such as microprocessors, CPUs or the like, such as general or special purpose microprocessors operable to execute programming instructions or micro-control code associated with operation of the washing machine appliance 100. The memory may represent random access memory such as DRAM or read only memory such as ROM or FLASH. The memory may be a separate component from the processor or may be included onboard within the processor. In one embodiment, the processor executes programming instructions stored in memory. It should be noted that the controller 166 as disclosed herein is capable of and may be operable to perform any methods and associated method steps as disclosed herein. For example, in some embodiments, methods disclosed herein may be embodied in programming instructions stored in the memory and executed by the controller 166.

Still referring to FIG. 1, the controller 166 may be positioned in a variety of locations throughout the washing machine appliance 100. In the illustrated embodiment, e.g., as shown in FIG. 1, the controller 166 is located adjacent to the control panel 160. In such embodiments, input/output ("I/O") signals are routed between the controller 166 and various operational components of the washing machine appliance 100 such as the control panel 160, sensors, graphical displays, and/or one or more alarms. In one embodiment, the control panel 160 may represent a general purpose I/O ("GPIO") device or functional block. The control panel 160 may be in communication with the controller via one or more signal lines or shared communication busses. As such, in an embodiment, a user of the washing machine appliance 100 may input and receive information regarding the operation of the washing machine appliance 100 at the control panel 160. A variety of text, digits, and/or symbols may be printed on control panel 160. In some embodiments, no text, digits, or symbols may appear on the control panel 160 unless the washing machine appliance 100 is in use.

Figure 3:
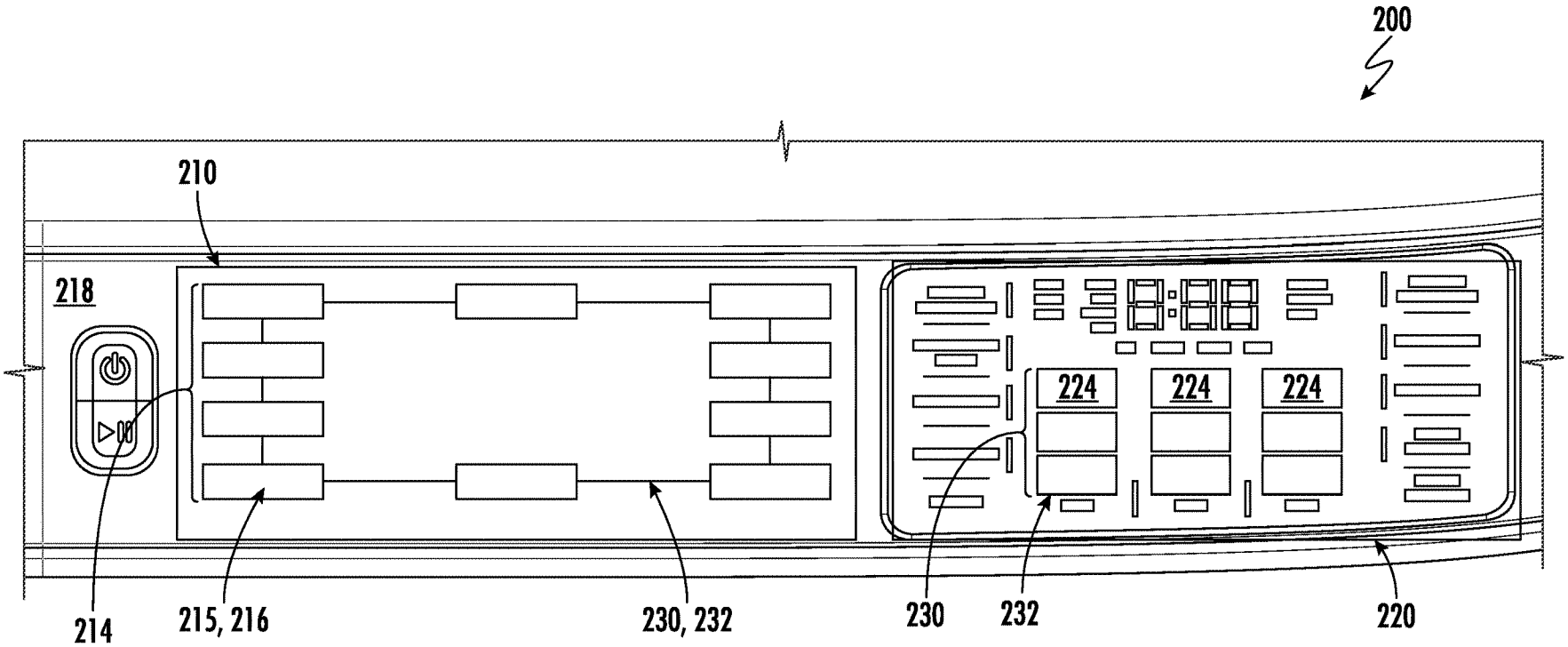
FIG. 3 provides a front view of a user interface of a washing appliance in accordance with embodiments of the present disclosure.

Referring now to FIGS. 2 and 3, a schematic diagram of an embodiment of the user interface 200 of the washing machine appliance 100 is depicted according to the present disclosure. Specifically, as shown, the user interface 200 of the washing machine appliance 100 is used for indicating a wash cycle 202 and/or a wash operation of a wash cycle 202. Further, as shown, the user interface 200 may have an input panel 210 and a display screen 220. Moreover, in an embodiment, as shown, the input panel 210 of the user interface 200 includes at least one input device 214 operatively coupled with the user interface 200 for selecting the wash cycle 202. In certain embodiments, the input device 214 can be one or more of a variety of electrical, mechanical, or electromechanical input devices including rotary dials, push buttons, toggle/rocker switches, and/or touch pads can also be used singularly or in combination with touch input components. For example, as shown in FIGS. 2 and 3, the input device 214 can be at least one of a turn knob 217 (FIG. 2), a plurality of push buttons 215, a capacitive touch screen with a plurality of capacitive touch inputs 216, or any combination thereof.

In addition, as shown in FIGS. 2 and 3, the user interface 200 further includes an arrangement 230 of light-emitting devices 232 that can be illuminated to animate at least one wash operation of the wash cycle 202 selected by a user. More specifically, in an embodiment, as shown, the light-emitting devices 232 can be light-emitting diodes (LEDs). In addition, as shown, the user interface 200 may include at least one audio device 218 for making sound to indicate one or more wash operations of the wash cycle 202.

Referring still to FIGS. 2 and 3, the display screen 220 of the user interface 200 may include a plurality of fixed words 224 (e.g., text related to wash cycles and/or wash operations) on the display screen 220. In such embodiments, the plurality of fixed words 224 can be operated by the user interface 200 by turning on and off the arrangement 230 of the light-emitting devices 232, which can be arranged behind the fixed words 224 such that illumination thereof illuminates one or more of the fixed words 224.

In certain embodiments, the arrangement 230 of the light-emitting devices 232 can have various configurations depending on the input device on the input panel 210. For example, as shown in FIG. 2, the arrangement 230 of the light-emitting devices 232 on the user interface 200 is arranged circumferentially around the turn knob 217 of the input panel 210. In another embodiment, as shown in FIG. 3, the arrangement 230 of the light-emitting devices 232 on the user interface 200 is arranged to correspond with the plurality of push buttons 215 and/or capacitive touch inputs 216. More particularly, in an embodiment, the arrangement 230 of the light-emitting devices 232 can be positioned at the respective input devices (e.g., push buttons 215, capacitive touch inputs 216) or arranged behind the respective input devices.

Accordingly, in an embodiment, the user interface 200 is configured to operate the arrangement 230 of the light-emitting devices 232 to animate the wash operations of the wash cycle 202. For example, in an embodiment, the user interface 200 is configured to operate the arrangement 230 of the light-emitting devices 232 by turning one or more of the light-emitting devices 232 on and off in a manner that corresponds to the wash operation during the wash cycle 202 selected by the user. The wash cycle 202 can include at least one wash operation, such as a plurality of wash operations. More specifically, the wash operation of the wash cycle 202 can include at least one of a fill sequence, a spin sequence, an agitation sequence, a drain sequence, a soak sequence, or any combination thereof, as will be discussed further with respect to FIGS. 4A-10. In some embodiments, such as with dishwasher appliances, the wash cycle 202 can also include a dry cycle, during which one or more of the light-emitting devices 232 are turned on and off in the manner that corresponds to or indicates a time remaining for completion of the dry cycle.

More specifically, FIGS. 4A-10 depict example wash operations of the wash cycle 202 being animated by the arrangement 230 of the light-emitting devices 232 by turning the light-emitting devices 232 on and off in a manner that corresponds to the wash operation during the wash cycle. In particular, as shown, FIGS. 4A-10 show the operation of the arrangement 230 of the light-emitting devices 232 at both the input panel 210 and the display screen 220 of the user interface 200. In the embodiments of FIGS. 4A-10, the input panel 210 is depicted with the turn knob 217. However, it is to be understood that the illustrated embodiments apply to user interfaces having other configurations, such as the plurality of push buttons 215 and the plurality of capacitive touch inputs 216 shown in FIG. 3. As such, operation of the arrangement 230 of the light-emitting devices 232 disclosed herein can be applied to input devices 214 having the turn knob 217, push buttons 215, capacitive touch inputs 216, or combinations thereof.

Figures 4A, 4B, 4C:
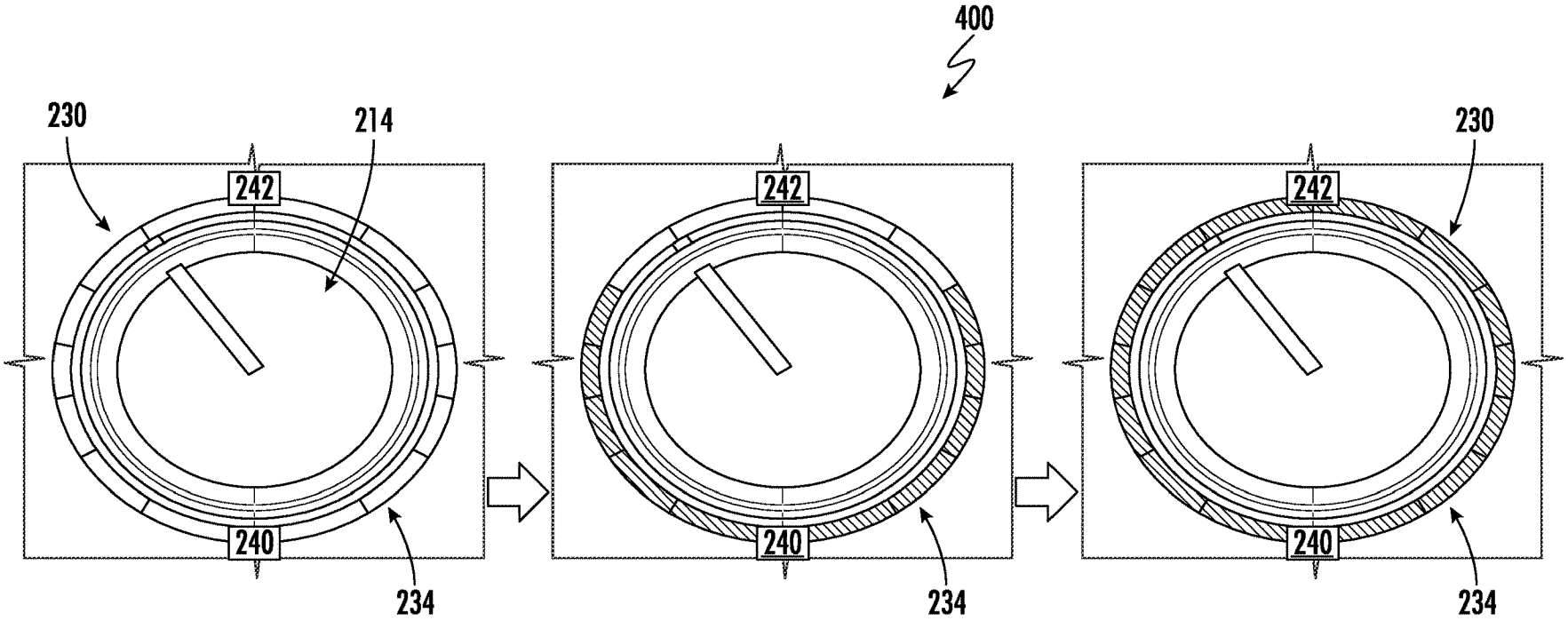
FIGS. 4A-4C provides a fill sequence indicated on a user interface of a washing appliance in accordance with embodiments of the present disclosure.

Turning particularly to FIGS. 4A-4C, the arrangement 230 of the light-emitting devices 232 is operated to correspond to a fill sequence 400. In particular, as shown, the arrangement 230 of the light-emitting devices 232 is arranged circumferentially around the turn knob 217 of the input panel 210. As such, during the fill sequence 400, the controller 166 is configured to turn one or more of the light-emitting devices 232 on and off in the manner that corresponds to the fill sequence 400. For example, as shown in FIG. 4A, the fill sequence 400 may begin with the arrangement of the light-emitting devices 232 turned off. Subsequently, as shown in FIG. 4B, a subset of the light-emitting devices 234 are turned on, e.g., starting from a bottom location 240 up to a top location 242 on the user interface 200 until all of the light-emitting devices 232 are turned on (FIG. 4C). In this way, the controller 166 operates the arrangement 230 of the light-emitting devices 232 to indicate a water level in the wash tub 124 of the washing machine appliance 100 rising during the fill sequence 400.

Figures 5A, 5B, 5C:
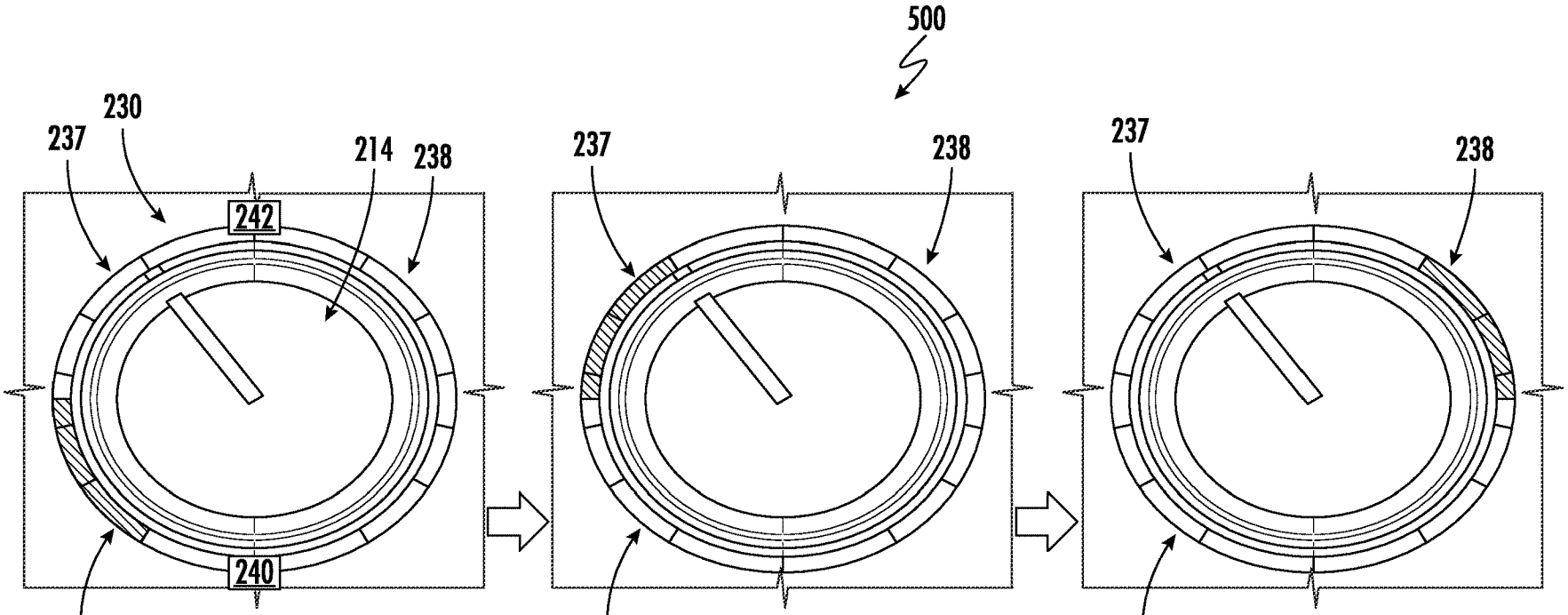
FIGS. 5A-5C provides a spin sequence indicated on a user interface of a washing appliance in accordance with embodiments of the present disclosure.

Turning now to FIGS. 5A-5C, the arrangement 230 of the light-emitting devices 232 is operated to correspond to a spin sequence 500. In particular, as shown, during the spin sequence 500, the controller 166 is configured to turn one or more of the light-emitting devices 232 on and off in the manner that corresponds to the spin sequence 500. For example, in an embodiment, the spin sequence 500 may begin with the arrangement 230 of the light-emitting devices 232 turned off. Subsequently, as shown, a plurality of subsets 236, 237, 238 of the light-emitting devices 232 are turned on and off starting with a first subset 236 turned on and with the remaining plurality of subsets 237, 238 turned off. Then, adjacent subsets are consecutively turned on and off in one of a clockwise or counterclockwise direction. As shown in FIG. 5B, the first subset 236 is turned off and an adjacent subset 237 in the clockwise direction is turned on. In FIG. 5C, adjacent subset 237 is turned off and another adjacent subset 238 is turned on. In this way, the controller 166 operates the arrangement of the light-emitting devices 232 to create a spinning or orbiting effect corresponding to a speed equivalent to a rotational speed of the wash basket 120 of the washing machine appliance 100 during the spin sequence 500.

Figures 6A, 6B, 6C, 6D:
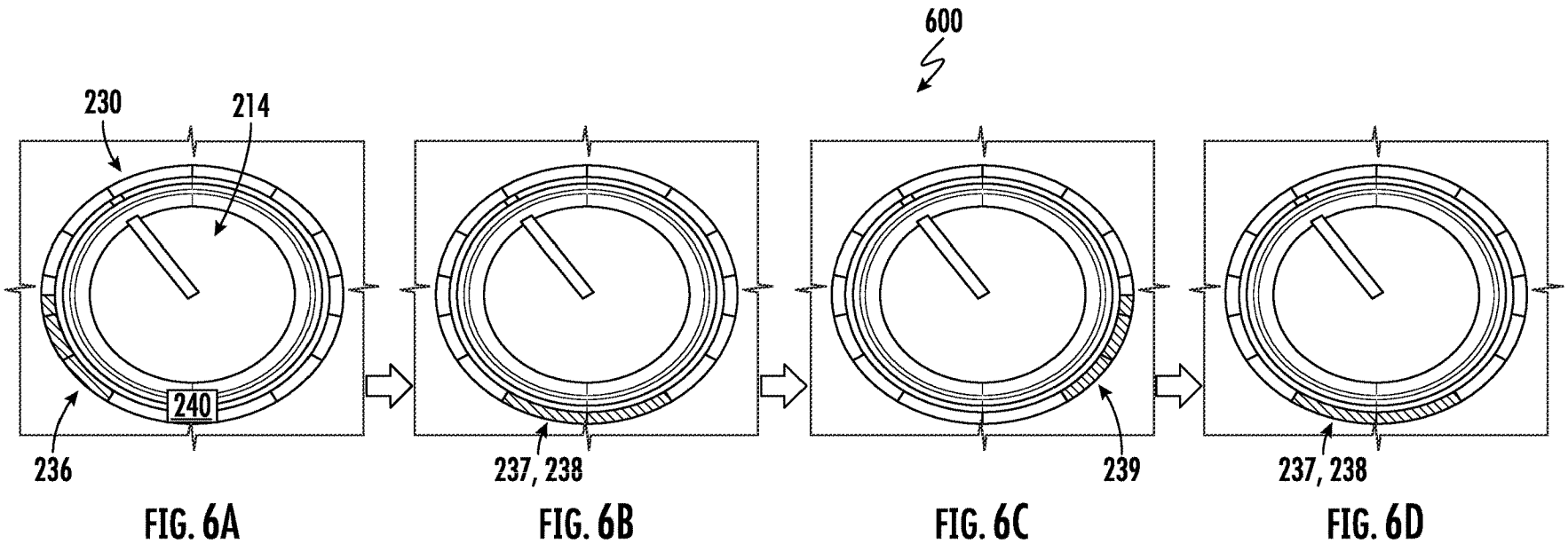
FIGS. 6A-6D provides an agitation sequence indicated on a user interface of a washing appliance in accordance with embodiments of the present disclosure.

Referring to FIGS. 6A-6D, the arrangement 230 of the light-emitting devices 232 is operated to correspond to an agitation sequence 600. In particular, as shown, during the agitation sequence 600, the controller 166 is configured to turn one or more of the light-emitting devices 232 on and off in the manner that corresponds to the agitation sequence 600. For example, in an embodiment, as shown, the agitation sequence 600 may begin with the arrangement 230 of the light-emitting devices 232 turned off. Subsequently, a plurality of subsets 236, 237, 238, 239 of the light-emitting devices 232 are turned on and off in a bi-directional sequence starting with a first subset 236 turned on and with the remaining plurality of subsets 237, 238, 239 turned off. Then, adjacent subsets are consecutively turned on and off along a bottom location 240 of the user interface 200 (e.g., knob 217) until a second subset 239 of the plurality of subsets is turned on (FIG. 6C). More particularly, as shown in FIG. 6B, the first subset 236 is turned off and adjacent subsets 237, 238 along the bottom location 240 of the user interface 200 are turned on in the counterclockwise direction. Proceeding along a bottom location 240 of the user interface 200, the adjacent subsets 237, 238 are turned on and off until the second subset 239 is turned on, as shown in FIG. 6C. After the second subset 239 is turned on and off, the bi-directional sequence proceeds in the clockwise direction along the bottom location 240 of the user interface 200. As shown in FIG. 6D, for example, the second subset 239 is turned off and the adjacent subsets 237, 238 are turned on and off until the first subset 236 is turned on. In this way, the controller 166 operates the arrangement 230 of the light-emitting devices 232 to create an oscillating effect corresponding to a back-and-forth rotation of the wash tub 124 of the washing machine appliance 100 during the agitation sequence 600.

Figures 7A, 7B, 7C:
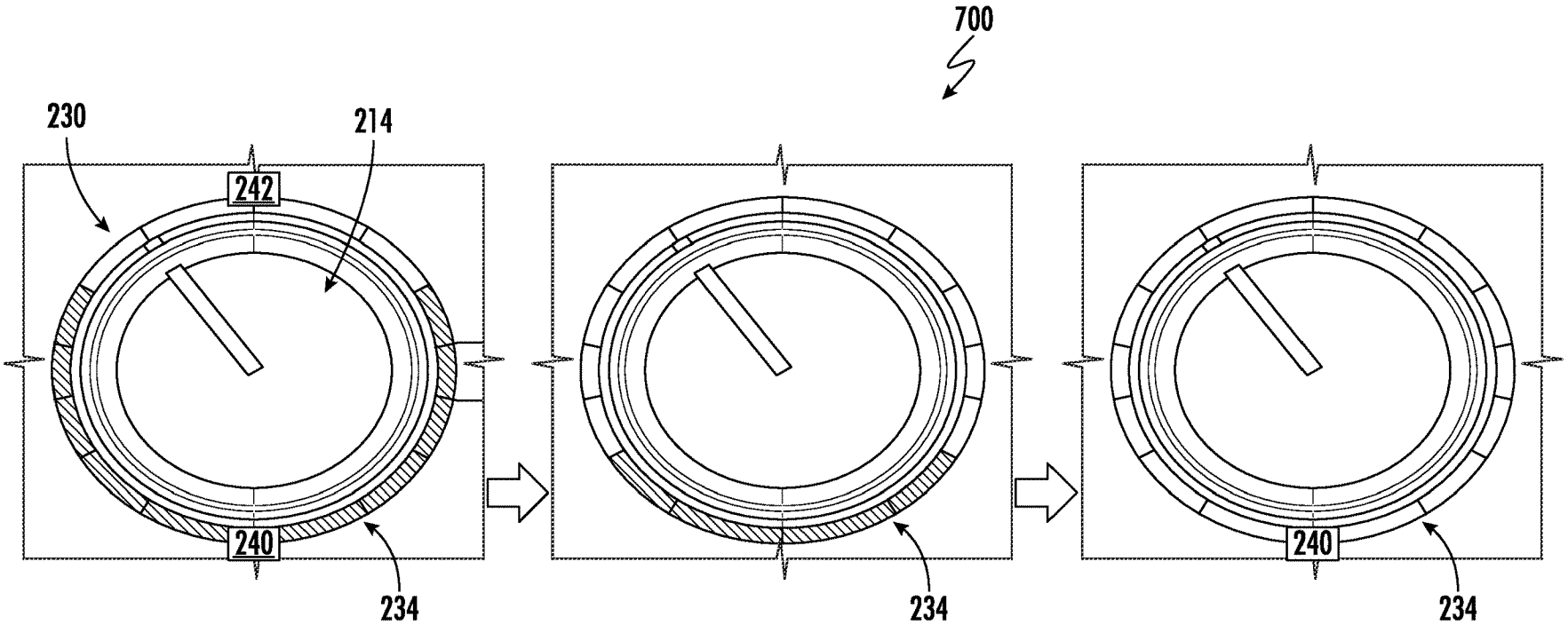
FIGS. 7A-7C provides a drain sequence indicated on a user interface of a washing appliance in accordance with embodiments of the present disclosure.

Turning to FIGS. 7A-7C, the arrangement 230 of the light-emitting devices 232 is operated to correspond to a drain sequence 700. In particular, during the drain sequence 700, the controller 166 is configured to turn one or more of the light-emitting devices 232 on and off in the manner that corresponds to the drain sequence 700. For example, as shown in FIG. 7A, the drain sequence 700 begins with the arrangement 230 of the light-emitting devices 232 turned on. Subsequently, as shown in FIG. 7B, a subset of the light-emitting devices 232 are turned off starting from the top location 242 down to the bottom location 240 on the user interface 200 until all of the light-emitting devices 232 are turned off (FIG. 7C). In this way, the controller 166 operates the arrangement 230 of the light-emitting devices 232 to indicate a water level in the wash tub 124 of the washing machine appliance 100 lowering during the drain sequence 700.

Figures 8A, 8B, 8C:
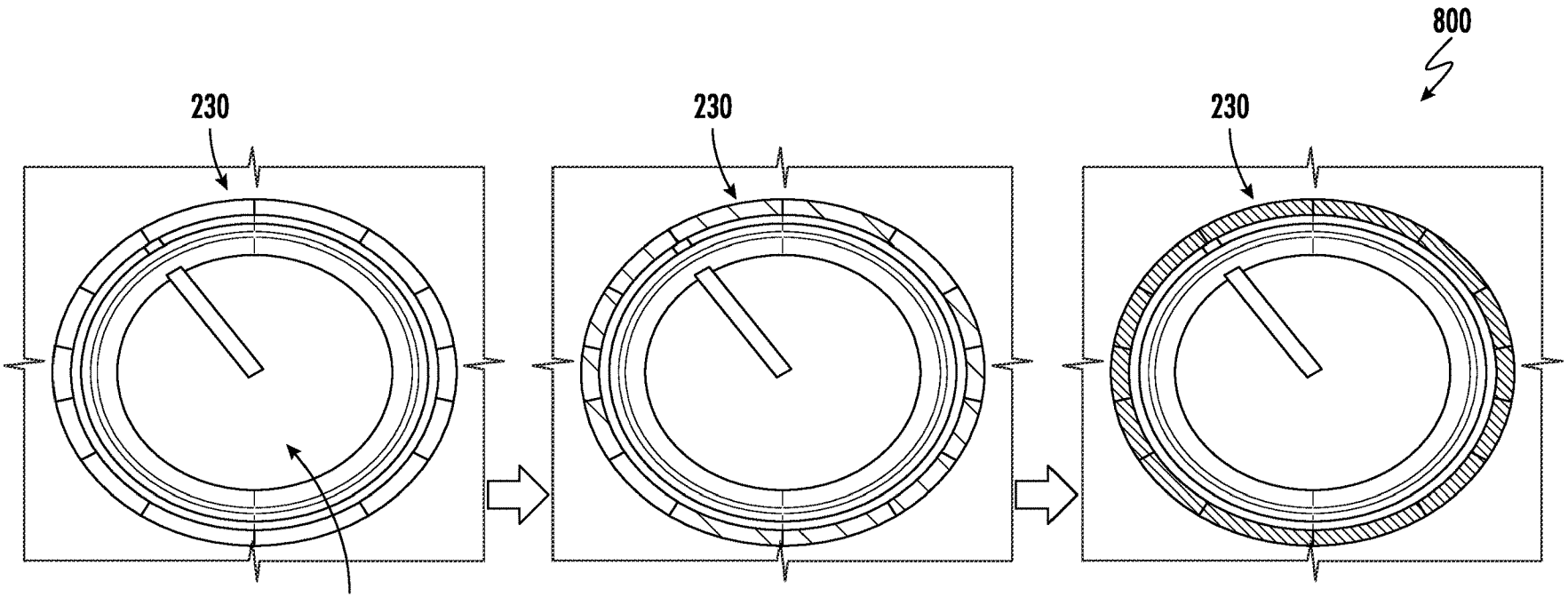
FIGS. 8A-8C provides a soak sequence indicated on a user interface of a washing appliance in accordance with embodiments of the present disclosure.

Referring to FIGS. 8A-8C, the arrangement 230 of the light-emitting devices 232 is operated to correspond to a soak sequence 800. In particular, during the soak sequence 800, the controller 166 is configured to turn one or more of the light-emitting devices 232 on and off in the manner that corresponds to the soak sequence 800. As shown in FIG. 8A, the soak sequence 800 begins with the arrangement of the light-emitting devices 232 turned off. Subsequently, as shown in FIGS. 8B-8C, an intensity of light emitted by the arrangement 230 of the light-emitting devices 232 is adjusted. For example, as shown, the light emitted by the arrangement 230 of the light-emitting devices 232 in FIG. 8C has a greater intensity than the light emitted in FIG. 8B. In this way, the controller 166 operates the arrangement of the light-emitting devices 232 to indicate a consistent water level in the wash tub 124 of the washing machine appliance 100 during the soak sequence 800.

Figures 9A, 9B, 9C:
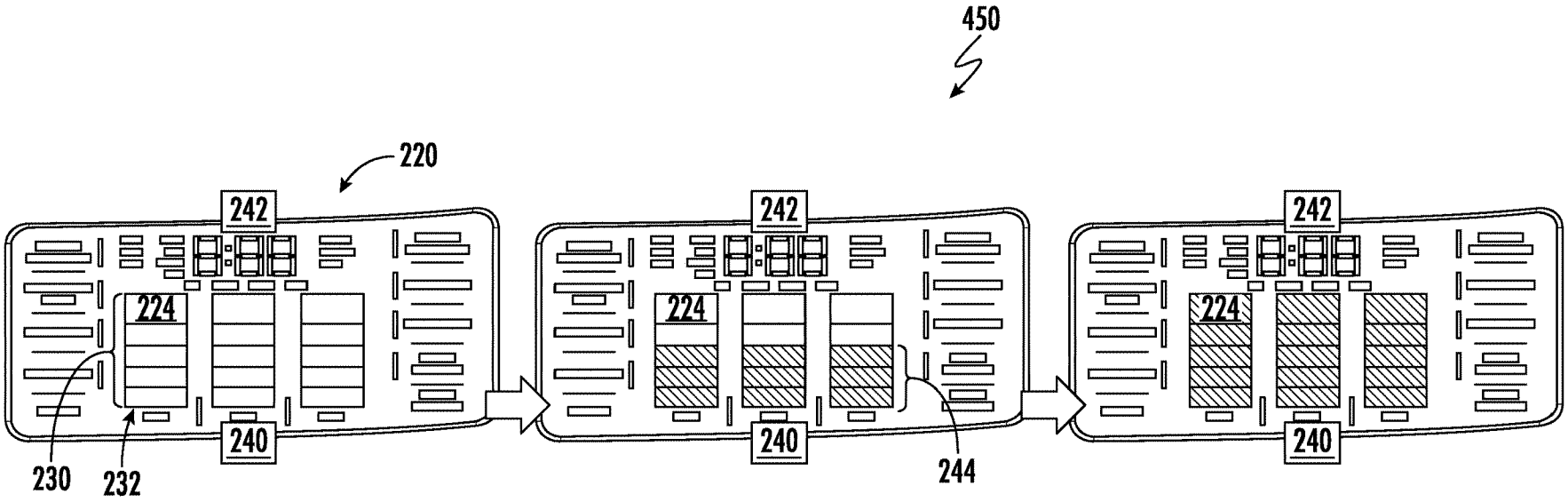
FIGS. 9A-9C provides a fill sequence indicated on a user interface of a washing appliance in accordance with embodiments of the present disclosure.
Figures 10A, 10B, 10C:
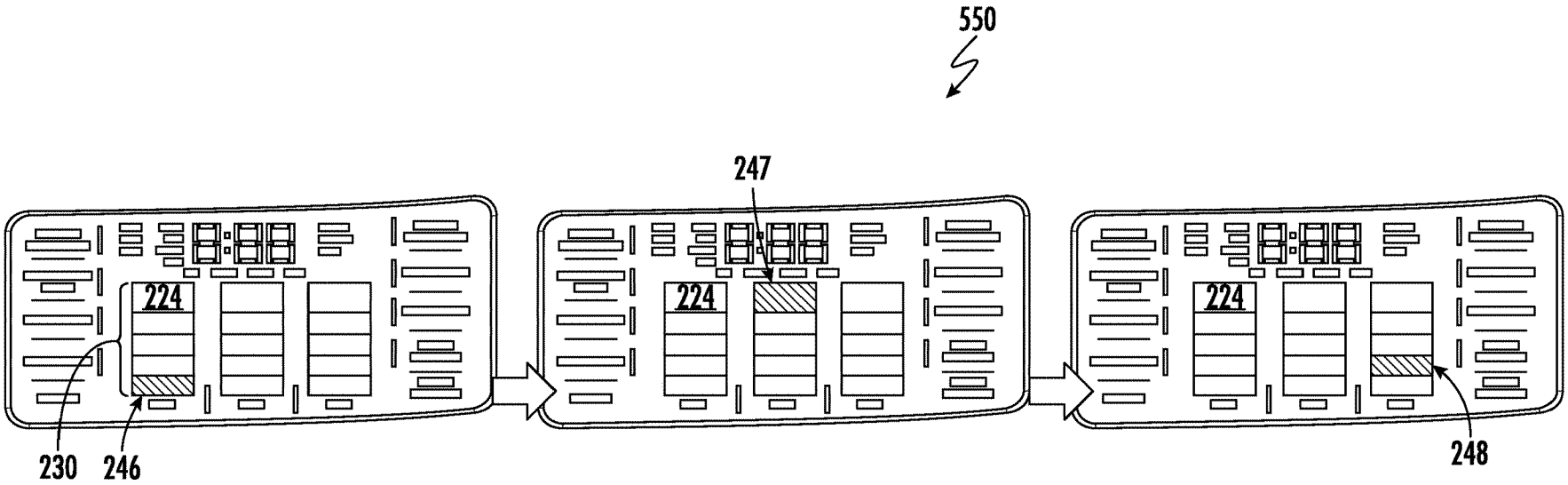
FIGS. 10A-10C provides a spin sequence indicated on a user interface of a washing appliance in accordance with embodiments of the present disclosure.

As described above, the arrangement 230 of the light-emitting devices 232 can be included on the display screen 220 of the user interface 200 (rather than around the knob 217) and also operated to animate the various wash operations of the wash cycle. Such operations can be similar to those described with reference to FIGS. 4A-8C). For example, FIGS. 9A-9C depict the arrangement 230 of light-emitted devices 232 on the display screen 220 being operated to correspond to a fill sequence 450 according to the present disclosure. FIGS. 10A-10C depict the arrangement of light-emitted devices 232 on the display screen 220 being operated to correspond to a spin sequence 550 according to the present disclosure.

Referring particularly to FIGS. 9A-9C, for example, the fill sequence 450 is depicted on the display screen 220 of the user interface 200 using the fixed words 224 being illuminated by the arrangement 230 of the light-emitting devices 232. Specifically, the arrangement 230 of the light-emitting devices 232 behind the plurality of fixed words 224 are operated to correspond to the fill sequence 450. In particular, as shown in FIG. 9A, the fill sequence 450 begins with the arrangement 230 of the light-emitting devices 232 turned off. Subsequently, as shown in FIG. 9B, a subset 244 of the light-emitting devices 232 in the display screen 220 are turned on starting from a bottom location 240 up to a top location 242 of the user interface 200 until all of the light-emitting devices 232 are turned on (FIG. 9C). In this way, the controller 166 operates the arrangement 230 of the light-emitting devices 232 in the display screen 220 to indicate a water level in the wash tub 124 of the washing machine appliance 100 rising during the fill sequence 450.

Turning now to FIGS. 10A-10C, for example, the spin sequence 550 is depicted on the display screen 220 of the user interface 200 using the fixed words 224 being illuminated by the arrangement 230 of the light-emitting devices 232. As shown in FIG. 10A, the spin sequence 550 on the display screen 220 begins with the arrangement 230 of the light-emitting devices 232, which are arranged behind the plurality of fixed words 224, turned off. Subsequently, a plurality of subsets 246, 247, 248 of the light-emitting devices 232 in the display screen 220 are turned on and off starting with a first subset 246 turned on and with the remaining plurality of subsets 247, 248 turned off, as shown in FIG. 10A. Then, adjacent subsets are consecutively turned on and off in one of a clockwise or counterclockwise direction. As shown in FIG. 10B, the first subset 246 is turned off and an adjacent subset 247 in the clockwise direction is turned on. In FIG. 10C, the adjacent subset 247 is turned off and another adjacent subset 248 is turned on. In this way, the controller 166 operates the arrangement 230 of the light-emitting devices 232 in the display screen 220 to create a spinning or orbiting effect corresponding to a speed equivalent or proportional to a rotational speed of the wash basket 120 of the washing machine appliance 100 during the spin sequence 550.

Figure 11:
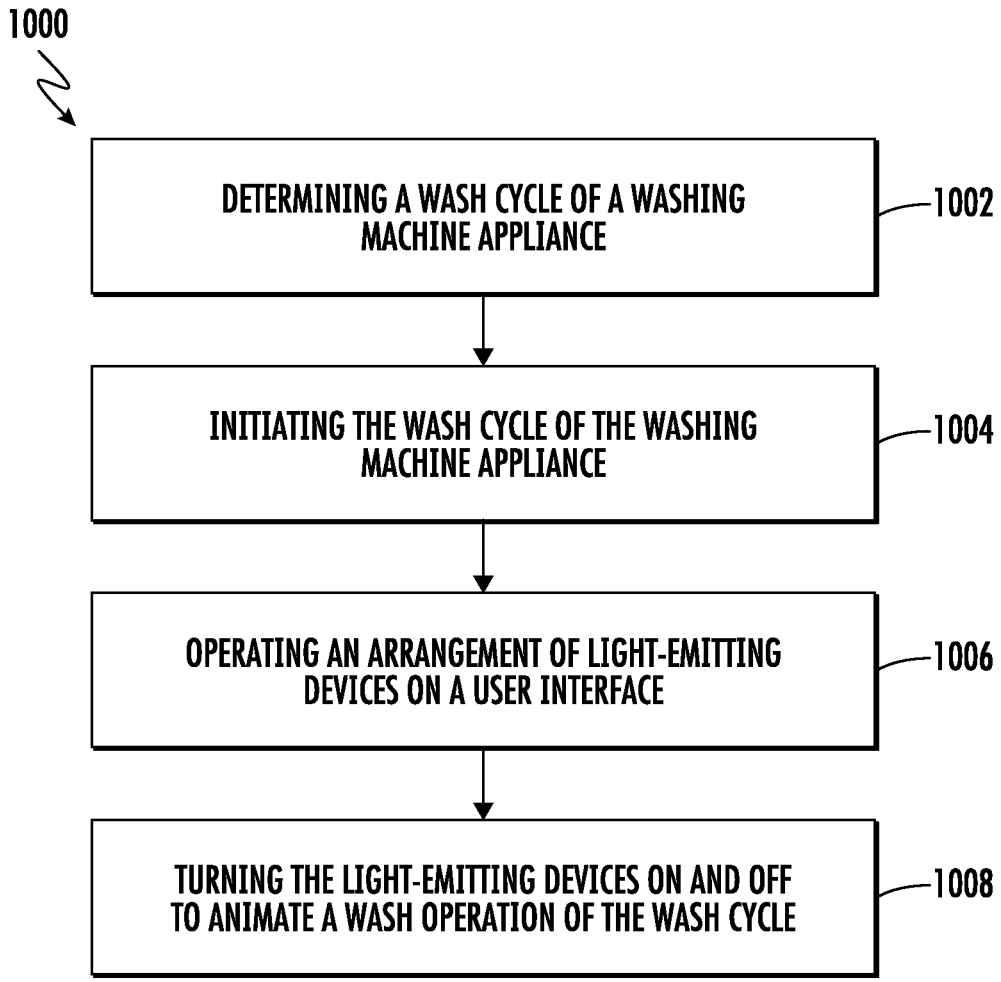
FIG. 11 provides a flow diagram of a method for indicating a wash operation of a wash cycle of a washing appliance on a user interface of the washing appliance.

Referring now to FIG. 11, a flow diagram of an embodiment of a method 1000 for operating a user interface of a washing machine appliance, such as washing machine appliance 100, to indicate a wash operation of a wash cycle in accordance with the present disclosure is illustrated. In general, the method 1000 will be described herein with reference to the washing machine appliance 100 and the user interface 200 of FIGS. 1-10C. However, it should be appreciated that the disclosed method 1000 may be implemented with any washing machine appliance and any user interface having any other suitable configurations. In addition, although FIG. 11 depicts steps performed in a particular order for purposes of illustration and discussion, the methods discussed herein are not limited to any particular order or arrangement. One skilled in the art, using the disclosures provided herein, will appreciate that various steps of the methods disclosed herein can be omitted, rearranged, combined, and/or adapted in various ways without deviating from the scope of the present disclosure.

As shown at (1002), the method 1000 includes initiating the wash cycle of the washing machine appliance. For example, according to an embodiment, the wash cycle 202 of the washing machine appliance 100 may be determined based on an input received at the input device 214, such as the knob 217, push buttons 215, capacitive touch inputs 216, or any combination thereof. In certain embodiments, for example, a user interacts with the input device 214 to select, via the user interface 200, the wash cycle 202 of the washing machine appliance 100. As explained above, the wash cycle 202 has at least one wash operation, which can include the fill sequence, the spin sequence, the agitation sequence, the drain sequence, the soak sequence, or any combination thereof. For example, the wash cycle 202 includes a plurality of wash operations. In such embodiments, initiating the wash cycle 202 includes performing the plurality of wash operations in a predetermined order beginning with a first wash operation of the plurality of wash operations. Each of the wash operations is performed and animated (FIGS. 4A-10C) in the predetermined order during the wash cycle 202.

As shown at (1004), the method 1000 includes operating an arrangement of light-emitting devices on the user interface. For example, according to an embodiment, the arrangement 230 of the light-emitting devices 232 on the user interface 200 of the washing machine appliance 100 are operated during the wash cycle 202 to animate one or more wash operations of the wash cycle 202. As shown at (1006), the method 1000 includes turning the light-emitting devices on and off to animate a wash operation of the wash cycle. As explained above, one or more of the light-emitting devices 232 included in the arrangement 230 of the light-emitting devices 232 can be turned on and off in a manner that corresponds to the wash operation during the wash cycle 202.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A method of indicating a wash operation of a wash cycle of a washing machine appliance on a user interface of the washing machine appliance, the method comprising:

initiating a wash cycle of the washing machine appliance via the user interface, the wash operation comprising at least one of a fill sequence, a spin sequence, an agitation sequence, a drain sequence, a soak sequence, or any combination thereof; and during the wash cycle, operating an arrangement of light-emitting devices on the user interface of the washing machine appliance to animate the wash operation of the wash cycle, wherein operating the arrangement of the light-emitting devices on the user interface of the washing machine appliance to animate the wash operation of the wash cycle comprises turning one or more of the light-emitting devices on and off in a manner that corresponds to the wash operation during the wash cycle, wherein, when the wash operation is the agitation sequence, turning one or more of the light-emitting devices on and off in the manner that corresponds to the wash operation during the wash cycle further comprises:

beginning with the arrangement of the light-emitting devices turned off and subsequently turning on and off a plurality of subsets of the light-emitting devices in a bi-directional sequence starting with a first subset turned on and with the remaining plurality of subsets turned off, and then proceeding by consecutively turning on and off adjacent subsets along a bottom location of the user interface until turning on a second subset, creating an oscillating effect corresponding to a rotation of a wash basket of the washing machine appliance during the agitation sequence.

2. The method of claim 1, wherein, when the wash operation is the fill sequence, turning one or more of the light-emitting devices on and off in the manner that corresponds to the wash operation during the wash cycle further comprises:

beginning with the arrangement of the light-emitting devices turned off and subsequently turning on a subset of the light-emitting devices starting from a bottom location up to a top location on the user interface until all of the light-emitting devices are turned on to indicate a water level in a wash tub of the washing machine appliance rising during the fill sequence.

3. The method of claim 1, wherein, when the wash operation is the spin sequence, turning one or more of the light-emitting devices on and off in the manner that corresponds to the wash operation during the wash cycle further comprises:

beginning with the arrangement of the light-emitting devices turned off and subsequently turning on and off a plurality of subsets of the light-emitting devices starting with a first subset turned on and with the remaining plurality of subsets turned off, and then proceeding by consecutively turning on and off adjacent subsets in one of a clockwise or counterclockwise direction, creating a spinning or orbiting effect corresponding to a speed equivalent or proportional to a rotational speed of a wash basket of the washing machine appliance during the spin sequence.

4. The method of claim 1, wherein, when the wash operation is the drain sequence, turning one or more of the light-emitting devices on and off in the manner that corresponds to the wash operation during the wash cycle further comprises:

beginning with the arrangement of the light-emitting devices turned on and subsequently turning off a subset of the light-emitting devices starting from a top location down to a bottom location on the user interface until all of the light-emitting devices are turned off to indicate a water level in a wash tub of the washing machine appliance lowering during the drain sequence.

5. The method of claim 1, wherein, when the wash operation is the soak sequence, turning one or more of the light-emitting devices on and off in the manner that corresponds to the wash operation during the wash cycle further comprises:

beginning with the arrangement of the light-emitting devices turned off and subsequently adjusting an intensity of light emitted by the arrangement of light-emitting devices to indicate a consistent water level in a wash tub of the washing machine appliance during the soak sequence.

6. The method of claim 1, wherein the user interface further comprises a controller operatively coupled with the user interface for selecting the wash cycle of the washing machine appliance and at least one input device, the at least one input device comprising at least one of a turn knob, a plurality of push buttons, a capacitive touch screen with a plurality of capacitive touch inputs, or any combination thereof.

7. The method of claim 6, wherein, when the at least one input device comprises the turn knob, at least a portion of the arrangement of the light-emitting devices on the user interface are arranged circumferentially around the turn knob.

8. The method of claim 1, wherein the user interface further comprises a display screen comprising a plurality of fixed words on the display screen, wherein at least a portion of the arrangement of the light-emitting devices are arranged behind the plurality of fixed words of the display screen.

9. The method of claim 1, wherein the light-emitting devices are light-emitting diodes (LEDs).

* * * * *